US010408569B2

(12) United States Patent
Abo

(10) Patent No.: US 10,408,569 B2
(45) Date of Patent: Sep. 10, 2019

(54) FIREARM AIMING DEVICE

(71) Applicant: Yigal Abo, Tiberius (IL)

(72) Inventor: Yigal Abo, Tiberius (IL)

( * ) Notice: Subject to any disclaimer, the term of this patent is extended or adjusted under 35 U.S.C. 154(b) by 0 days.

(21) Appl. No.: 15/695,582

(22) Filed: Sep. 5, 2017

(65) Prior Publication Data

US 2018/0045487 A1 Feb. 15, 2018

Related U.S. Application Data

(60) Division of application No. 14/974,121, filed on Dec. 18, 2015, now abandoned, which is a continuation-in-part of application No. 14/212,869, filed on Mar. 14, 2014, now abandoned.

(30) Foreign Application Priority Data

Mar. 17, 2013 (IL) ..... 225266

(51) Int. Cl.
*F41G 1/34* (2006.01)
*F41G 1/12* (2006.01)

(52) U.S. Cl.
CPC ..... *F41G 1/345* (2013.01); *F41G 1/12* (2013.01)

(58) Field of Classification Search
CPC ..... F41G 1/06; F41G 1/16; F41G 1/32; F41G 1/22; F41G 1/345
USPC ..... 42/132, 144, 145, 111, 130, 131, 137, 42/124
See application file for complete search history.

(56) References Cited

U.S. PATENT DOCUMENTS 1,852,875 A * 4/1932 Endrezze ..... F41G 1/12 42/144
2,610,405 A * 9/1952 Dickinson ..... F41G 1/02 42/143
3,495,339 A * 2/1970 Elliason ..... F41G 1/26 42/137
4,494,327 A * 1/1985 Cullity ..... F41G 1/06 42/132
4,918,823 A * 4/1990 Santiago ..... F41G 1/32 42/132
4,945,667 A * 8/1990 Rogalski ..... F41G 1/34 42/114
4,993,158 A * 2/1991 Santiago ..... F41G 1/32 42/135
5,065,519 A * 11/1991 Bindon ..... F41G 1/32 42/145
5,359,800 A * 11/1994 Fisher ..... F41G 1/345 42/144
5,467,552 A * 11/1995 Cupp ..... F41G 1/26 42/125
RE35,347 E * 10/1996 Bindon ..... F41G 1/32 42/144

(Continued)

*Primary Examiner* — Jonathan C Weber
(74) *Attorney, Agent, or Firm* — Mark David Torche; Patwrite Law

(57) ABSTRACT

A rear-sight aiming device to aid a shooter of a firearm. The device includes a housing with a tunnel alignable with the front aiming sight; an elongated optical fiber in a non-linear configuration is disposed inboard within the tunnel; an annular light-transmitting cylinder, disposed within the tunnel between the optical fiber and the shooter of the firearm during shooting; and a self-activating light source coaxially and completely disposed within the cylinder.

11 Claims, 9 Drawing Sheets

(56) References Cited

U.S. PATENT DOCUMENTS 5,836,100 A * 11/1998 Stover ..... F41G 1/345 42/132
5,924,234 A * 7/1999 Bindon ..... G02B 27/34 33/298
5,956,854 A * 9/1999 Lorocco ..... F41G 1/32 42/132
6,122,833 A * 9/2000 Lorocco ..... F41G 1/32 42/132
6,233,836 B1 * 5/2001 Uhlmann ..... F41G 1/345 42/145
6,360,471 B1 * 3/2002 Stein ..... F41G 1/01 42/122
6,385,855 B1 * 5/2002 Tymianski ..... F41G 1/345 33/263
6,601,308 B2 * 8/2003 Khoshnood ..... F41G 1/467 124/87
6,967,775 B1 * 11/2005 Millett ..... G02B 23/10 359/399
RE39,686 E * 6/2007 Khoshnood ..... F41G 1/467 124/87
7,562,486 B2 * 7/2009 LoRocco ..... F41G 1/345 42/132
7,627,976 B1 * 12/2009 Olson ..... F41G 1/345 42/132
7,739,825 B2 * 6/2010 LoRocco ..... F41G 1/345 33/265
7,921,591 B1 * 4/2011 Adcock ..... F41G 1/14 42/113
8,009,958 B1 * 8/2011 Schick ..... F41G 1/345 33/297
8,037,634 B2 * 10/2011 Price ..... F41G 1/01 42/111
8,161,675 B2 * 4/2012 Sne ..... F41G 1/027 42/111
8,230,637 B2 * 7/2012 Lamb ..... F41G 1/345 42/132
8,245,409 B2 * 8/2012 Varner ..... F41G 1/467 124/87
8,579,450 B2 * 11/2013 Profos ..... F41G 1/32 362/84
8,635,800 B2 * 1/2014 Glimpse ..... F41G 1/02 42/132
8,635,801 B2 * 1/2014 Glimpse ..... F41G 1/02 42/132
8,677,674 B2 * 3/2014 Glimpse ..... F41G 1/02 42/132
8,813,413 B2 * 8/2014 Howe ..... F41G 1/08 42/132
8,925,237 B2 * 1/2015 Howe ..... F41G 1/345 42/132
9,335,165 B2 * 5/2016 Profos ..... F41G 1/345
2003/0121163 A1 * 7/2003 Khoshnood ..... F41G 1/467 33/265
2007/0107292 A1 * 5/2007 Bar-Yona ..... F41G 1/027 42/144
2008/0168671 A1 * 7/2008 Rager ..... F41G 1/467 33/265
2009/0013581 A1 * 1/2009 LoRocco ..... F41G 1/345 42/132
2009/0100735 A1 * 4/2009 Schick ..... F41G 1/345 42/123
2010/0088944 A1 * 4/2010 Callihan ..... F41G 1/01 42/145
2011/0107650 A1 * 5/2011 Howe ..... F41G 1/10 42/132
2011/0249428 A1 * 10/2011 Profos ..... F41G 1/32 362/159
2011/0314721 A1 * 12/2011 Lamb ..... F41G 1/10 42/145
2012/0144721 A1 * 6/2012 Glimpse ..... F41G 1/02 42/132
2012/0151817 A1 * 6/2012 Howe ..... F41G 1/345 42/132
2013/0185983 A1 * 7/2013 Glimpse ..... F41G 1/02 42/132
2013/0185984 A1 * 7/2013 Glimpse ..... F41G 1/02 42/132
2014/0150325 A1 * 6/2014 Keng ..... F41G 11/003 42/118

* cited by examiner

FIREARM AIMING DEVICE

CROSS REFERENCE TO RELATED APPLICATIONS

This application is a divisional, of application Ser. No. 14/974,121 filed on Dec. 18, 2015, entitled FIREARM AIMING DEVICE, which is a Continuation-in-Part (CIP) of U.S. patent application Ser. No. 14/212,869, entitled FIREARM AIMING DEVICE AND ATTACHMENT MECHANISM THEREFOR, filed on filed Mar. 14, 2014, which claims priority from Israel patent application IL 225266 entitled FIREARM AIMING DEVICE AND ATTACHMENT MECHANISM THEREFOR, filed on 17 Mar. 2013, the complete disclosures of each of which are hereby incorporated by reference.

FIELD OF THE INVENTION

The present invention relates to firearms, in particular aiming devices therefor.

BACKGROUND OF THE INVENTION

Fire arms, particularly hand-held fire arms are conventionally aimed by aligning a front sight with a rear sight and pointing the front sight to the target point. The ease and speed of the alignment of such aiming devices can be critical. As well, ease of assembly and adjustment of the aiming device is an important factor.

It is believed that the technology relevant to the present invention is disclosed in U.S. Pat. No. 8,161,675 (Sne, et al.); U.S. Pat. No. 7,921,591 (Adcock); U.S. Pat. No. 7,627,976 (Olson); U.S. Pat. No. 7,562,486 (LoRocco); U.S. Pat. No. 6,385,855 (Tymianski); U.S. Pat. No. 6,360,471 (Stein); U.S. Pat. No. 5,065,519 (Bindon); U.S. Pat. No. 4,945,667 (Rogalski, et al.); U.S. Pat. No. 4,918,823 (Santiago); U.S. Pat. No. 1,852,875 (Endrezze); US 2013/185,983 (Glimpse); US 2012/151,817 (Howe et al.); US 2011/249,428 (Profus); US 2010/088,944 (Callihan); US 2007/107,292 (Bar-Yona, et al.); and AU 2010/326,607 (Profus).

SUMMARY OF THE INVENTION

The present invention relates to an aiming device or gun sight for firearms and an attachment mechanism therefor. The aiming device and attachment mechanism are particularly useful for aiming/using hand-held guns, such as pistols and revolvers or short range rifles.

In accordance with embodiments of one aspect of the present invention there is provided a rear-sight aiming device to aid a shooter of a firearm. The firearm has a barrel, an aiming device attachment member receiving slot of the tapering type, and a front aiming sight. The rear-sight aiming device includes: an elongated housing having a tunnel therein, the tunnel being configured so it is parallely arrangeable with the firearm's barrel and alignable with the front aiming sight and having at least one light admitting opening to the tunnel, the housing further having an inwardly tapered groove that is generally crosswise to the longitudinal axis of the elongated housing; an elongated optical fiber having a front end and a rear end, and the optical fiber is disposed inboard within the tunnel whereby at least a portion of the optical fiber is operably associated with the at least one light admitting opening; an annular light-transmitting cylinder, with a front annular surface and a rear annular surface, being open at both ends thereof and having an outer diameter and an inner diameter, the translucent annular light-transmitting cylinder being disposed within the tunnel between the optical fiber and the shooter of the firearm during shooting; a self-activating light source having a front end and a rear end, the self-activating light source being disposed coaxially within the annular light-transmitting cylinder and completely housed within the annular light-transmitting cylinder, whereby the self-activating light source is proximal the shooter of the firearm during shooting during shooting of the firearm; and an attachment mechanism configured to attach the aiming device to the firearm, This design allows the firearm to be aimed in a light or dark environment by aligning, with the front aiming sight of the firearm, the self-activating light source or the annular light-transmitting cylinder, which provide a shooter of the firearm with an illuminated dot by the self-activating light source or an illuminated annular surface produced by the optical fiber, as transmitted through the light-transmitting cylinder.

In the specification and claims, the term "aiming device", or derivatives thereof, may be used interchangeably with the term "gun sight" or derivatives thereof. Likewise, the terms "gun", "firearm", "pistol" and the like, and their derivatives, may be used interchangeably herein the specification and claims.

Particular features of some embodiments of the present aiming device that it is conveniently used in both conditions of light and darkness; it is easy to manufacture and assemble; and it includes an attachment mechanism that is easy to use and allows easy and convenient adjustment, even in the field.

BRIEF DESCRIPTION OF THE DRAWINGS

The present invention will be understood and appreciated more fully from the following detailed description taken in conjunction with the appended drawings in which:

FIG. 2 being an assembled view of FIG. 1; and FIG. 3 being an bottom perspective view of FIG. 1;

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF THE INVENTION

Illustrative embodiments of the invention are described below. In the interest of clarity, not all features/components of an actual implementation are necessarily described.

Figure 1:
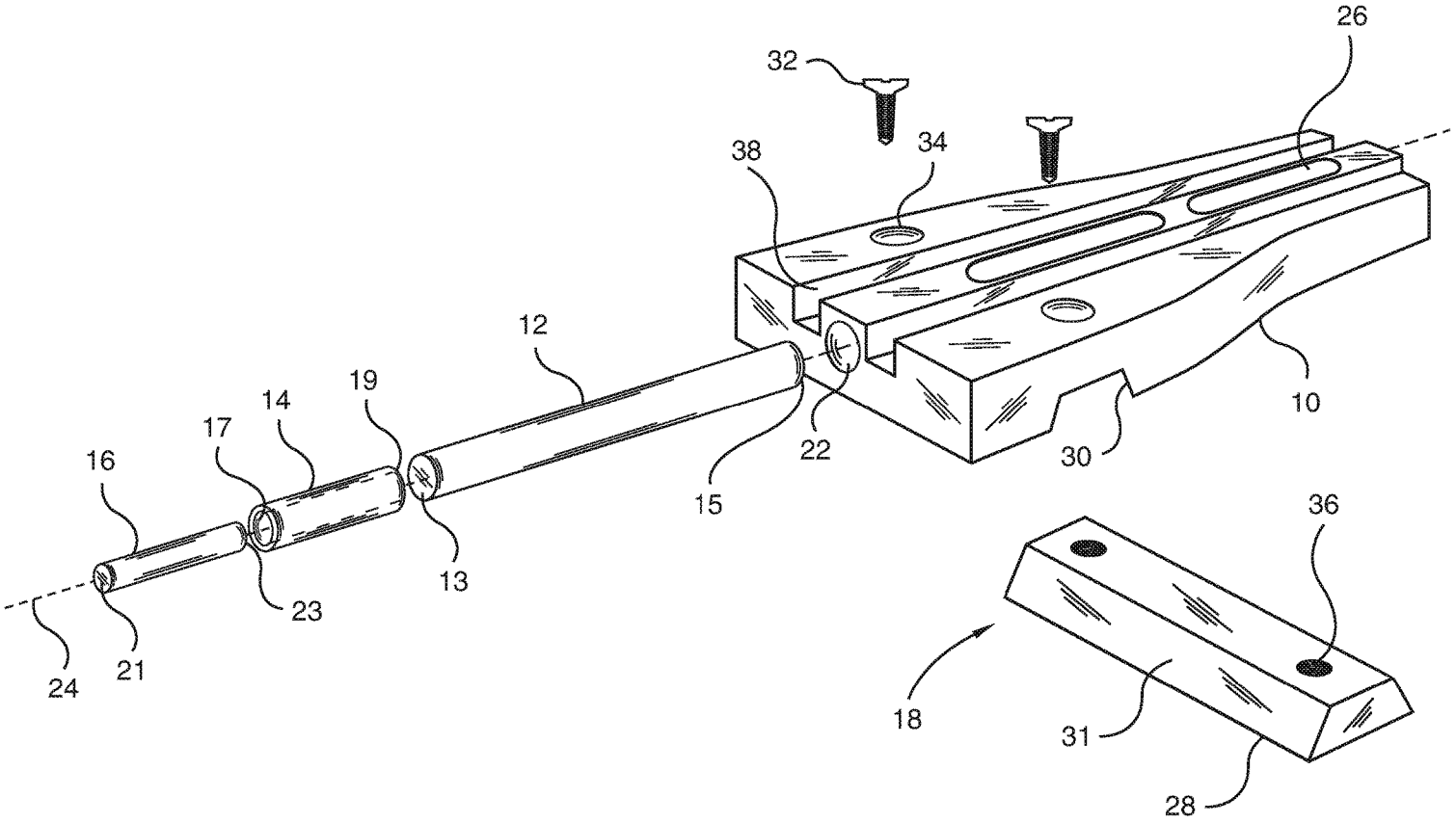
FIGS. 1-3 are view of embodiments of an aiming device of the present invention, FIG. 1 being an exploded perspective view.
Figure 2:
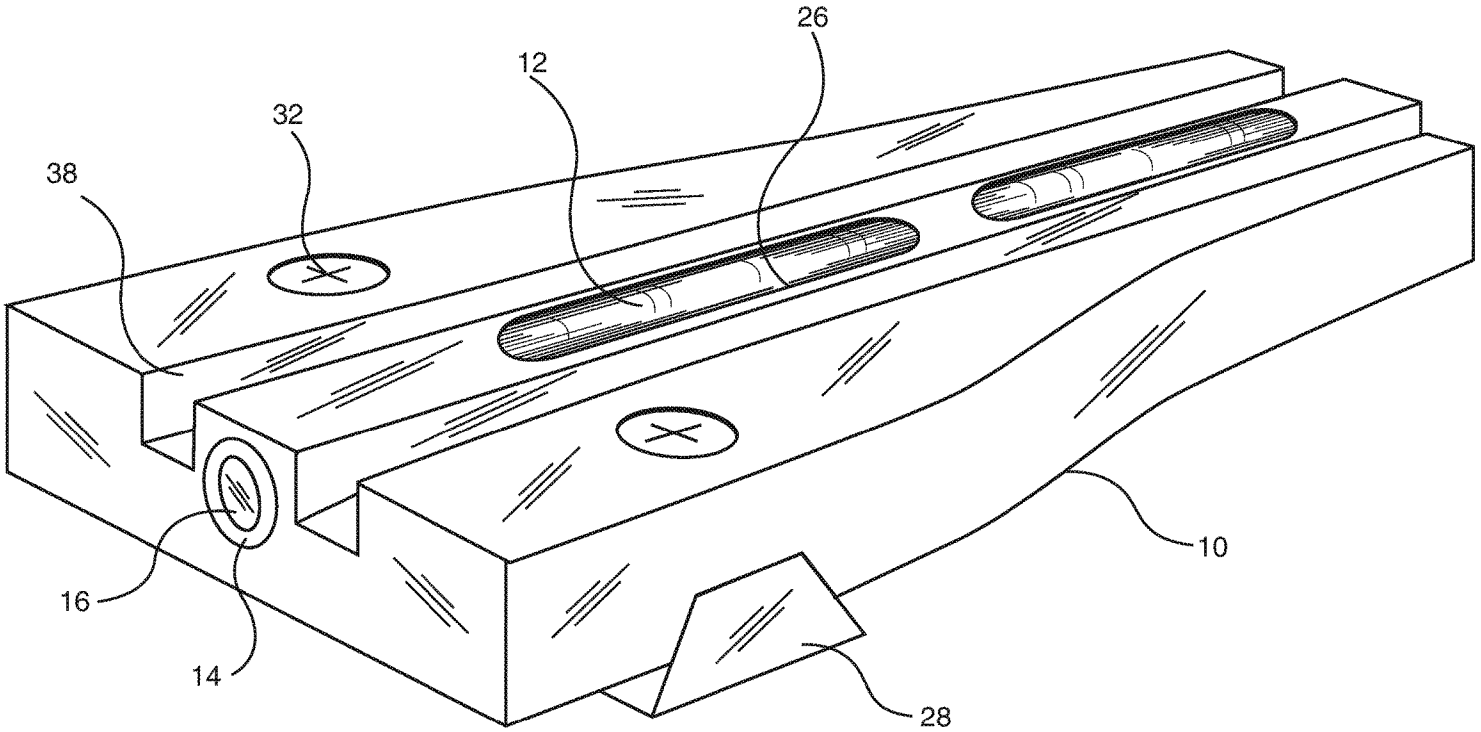
Figure 3:
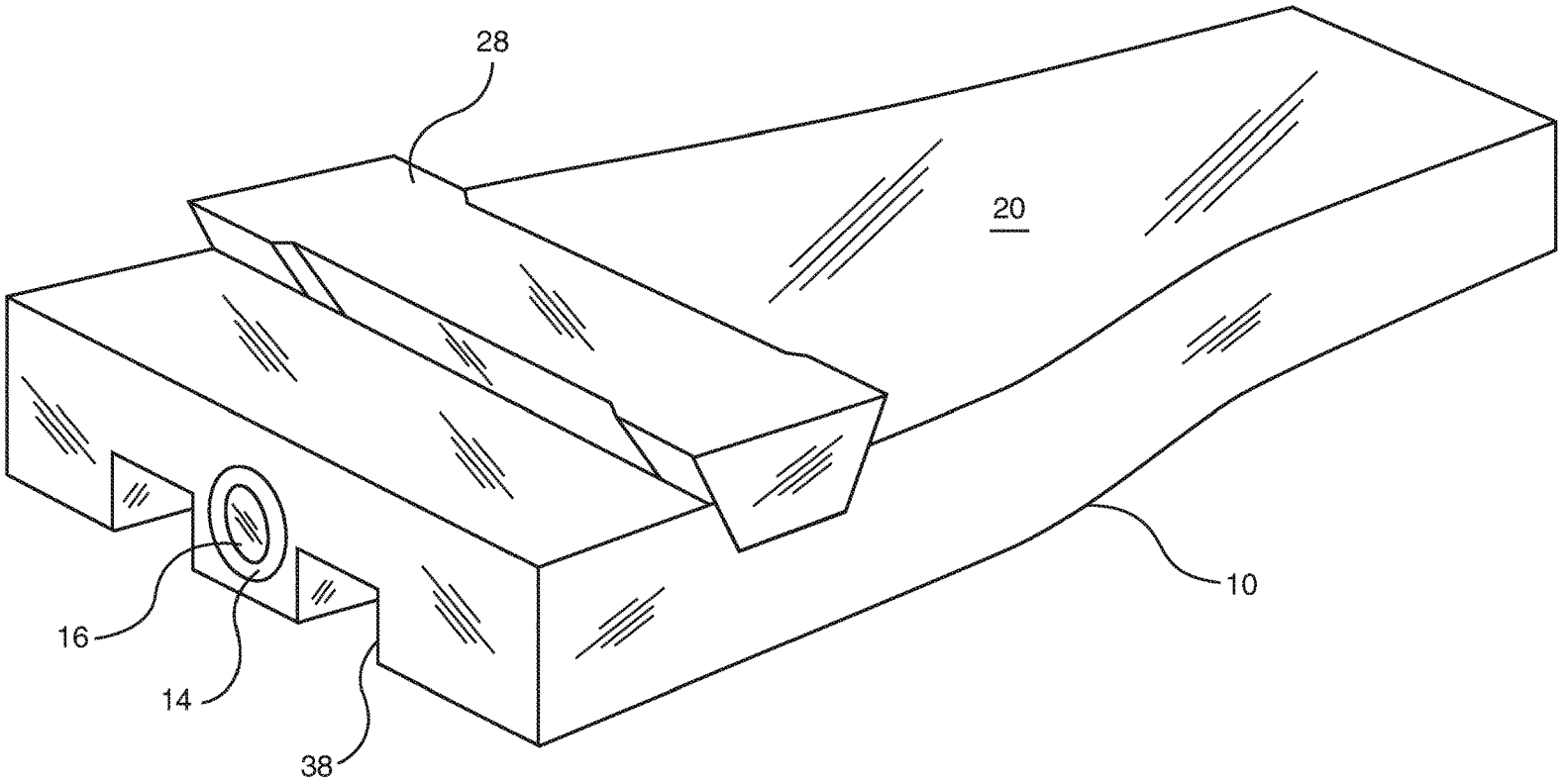

FIGS. 1-3 show embodiments of an aiming device of the present invention. The aiming device includes an elongated housing 10, which in particular embodiments is opaque; an elongated optical fiber 12 disposed within the housing; an annular light-transmitting cylinder 14 aligned with the optical fiber; a self-activating light source 16, disposed coaxially within the cylinder; and a gun sight attachment mechanism 18 for attaching the aiming device to a gun. Light source 16 may include or be constituted by a gaseous tritium light source (GTLS), for example a Trigalight™, which is particularly convenient as it is self-activating and requires no outside power source.

Optical fiber 12 is preferably in the form of a rod or bar, which are common and inexpensive forms for an optical fiber, i.e. without any lumen or hollow portion. Optical fiber 12 has a front end 13 (facing the shooter when aiming) and a rear end 15. Annular light-transmitting cylinder 14 has a front annular surface 17 (facing the shooter when aiming) and a rear annular surface 19. Self-activating light source 16 has a front end 21 (facing the shooter when aiming) and a rear end 23. Light-transmitting cylinder 14 has an annular end-profile and thus defines a cavity configured for receiving self-activating light source 16, and the self-activating light source 16 is completely housed within the light-transmitting cylinder 14.

In other words, no portion of self-activating light source 16 is housed within optical fiber 12 nor within any other component that may be found in such aiming systems, such as a lens or the like. As such, the present aiming sight design allows for simple assembly and manufacturing by precluding a more complicated and/or expensive optical fiber or lens, etc.

In some embodiments, self-activating light source 16 is disposed within annular light-transmitting cylinder 14 such that front end 21 of light source 16 is flush with front annular surface 17 of light-transmitting cylinder 14. Self-activating light source 16 can be held within light-transmitting cylinder 14 via a variety of means including, for example, a pressure fit, adhesive, or mechanical means, an example of which is described herein below. In some embodiments, self-activating light source 16 is disposed within light-transmitting cylinder 14 such that front end 21 of light source 16 is somewhat inboard of (recessed from) front annular surface 17 of light-transmitting cylinder 14, as described below.

Housing 10 is typically an elongated structure with a generally flat bottom surface 20 that interfaces with the top of the gun's barrel, or slide in the case of guns with a slide. Optical fiber 12 typically fits inboard and typically snugly within an elongated recess or tunnel 22 within housing 10 and typically along the longitudinal axis 24 of the housing. Tunnel 22 has at least a portion thereof that faces generally upward and is open to the surrounding or significantly transparent for allowing ambient light to reach optical fiber 12, and will be referred to as a light admitting opening or window 26 (two illustrated).

Optical fiber 12 is disposed (inserted) a bit inboard within elongated tunnel 22 to allow space for the insertion of annular light-transmitting cylinder 14 within the tunnel. As mentioned, light source 16 is coaxially disposed (inserted) within cylinder 14; i.e. completely housed therein. As such, the shooter will be provided an illuminated mark (a dot by way of the light source if at night/darkness; and an annular surface or circle via the cylinder 14 if during daylight) dot or thereby transferring light from optical fiber 12 toward the shooter. Thus, the aiming device can be conveniently used both in daylight and at night or other such low-light conditions.

An exemplary, and particularly utilitarian attachment mechanism 18 is illustrated that includes an outwardly flaring/angled dove-tail shaped attachment member 28 slidingly fitting into a correspondingly shaped tapered groove 30 that is generally transverse or crosswise to longitudinal axis 24. As such, attachment member has smoothly surfaced and flat side walls 31 that angle outwardly. Attachment mechanism 18 also includes at least one and typically two screws 32 passing through respective through-holes 34 in housing 10 at the location of groove 30. Screws 32 correspond to respective threaded female screw receiving recesses 36, in attachment member 28. As such, tightening screws 32 pulls attachment member 28 upward into groove 30. This tightening makes bottom surface 20 of housing 10 lay flush (flat) on the top of the gun, as can be seen. Prior to fully tightening screws 32, housing 10 can be is adjusted right/left (i.e. crossways with respect to the gun and front aiming sight 91) to align the illumination "marks" with the front aiming sight. Such attachment mechanism 18 is particularly convenient as it allows easy adjustment of the aiming device in the field, if required. And, no zeroing is required.

Figure 4:
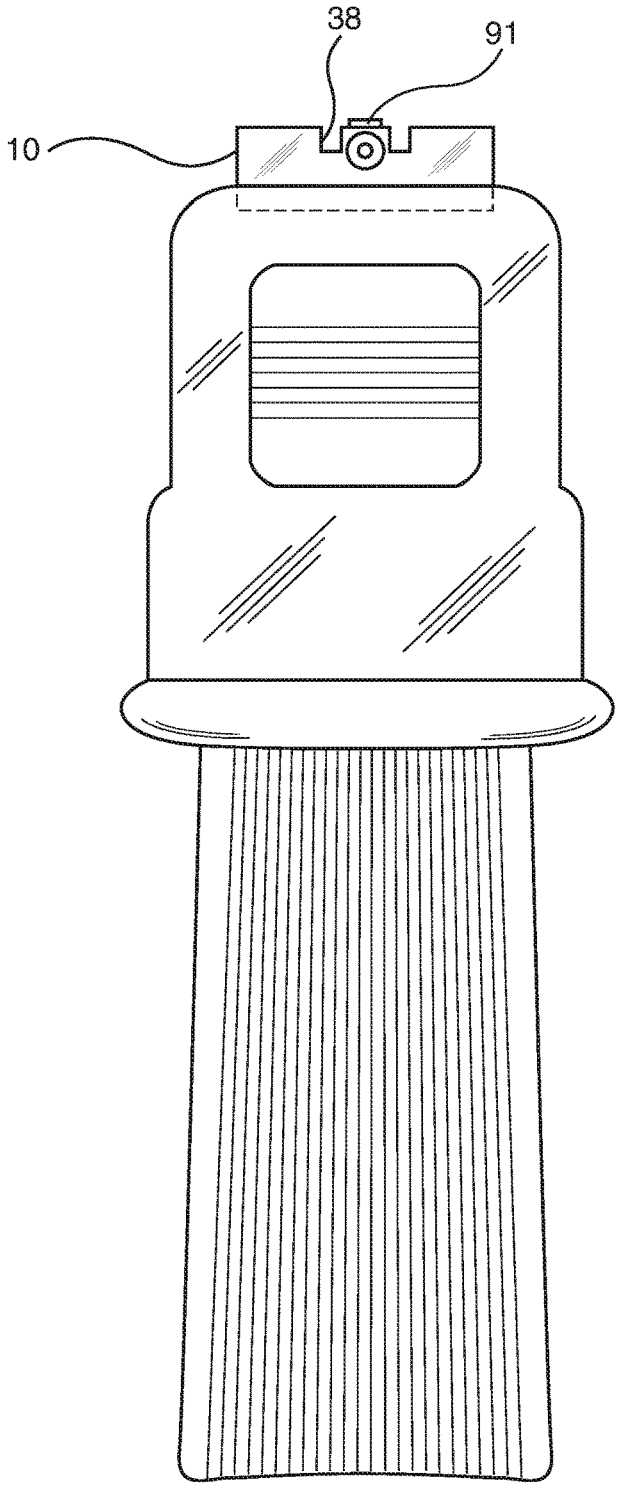
FIGS. 4-5 are views of a firearm with embodiments of the present aiming device attached thereto, FIG. 4 being a rear view and FIG. 5 being a perspective view.
Figure 5:
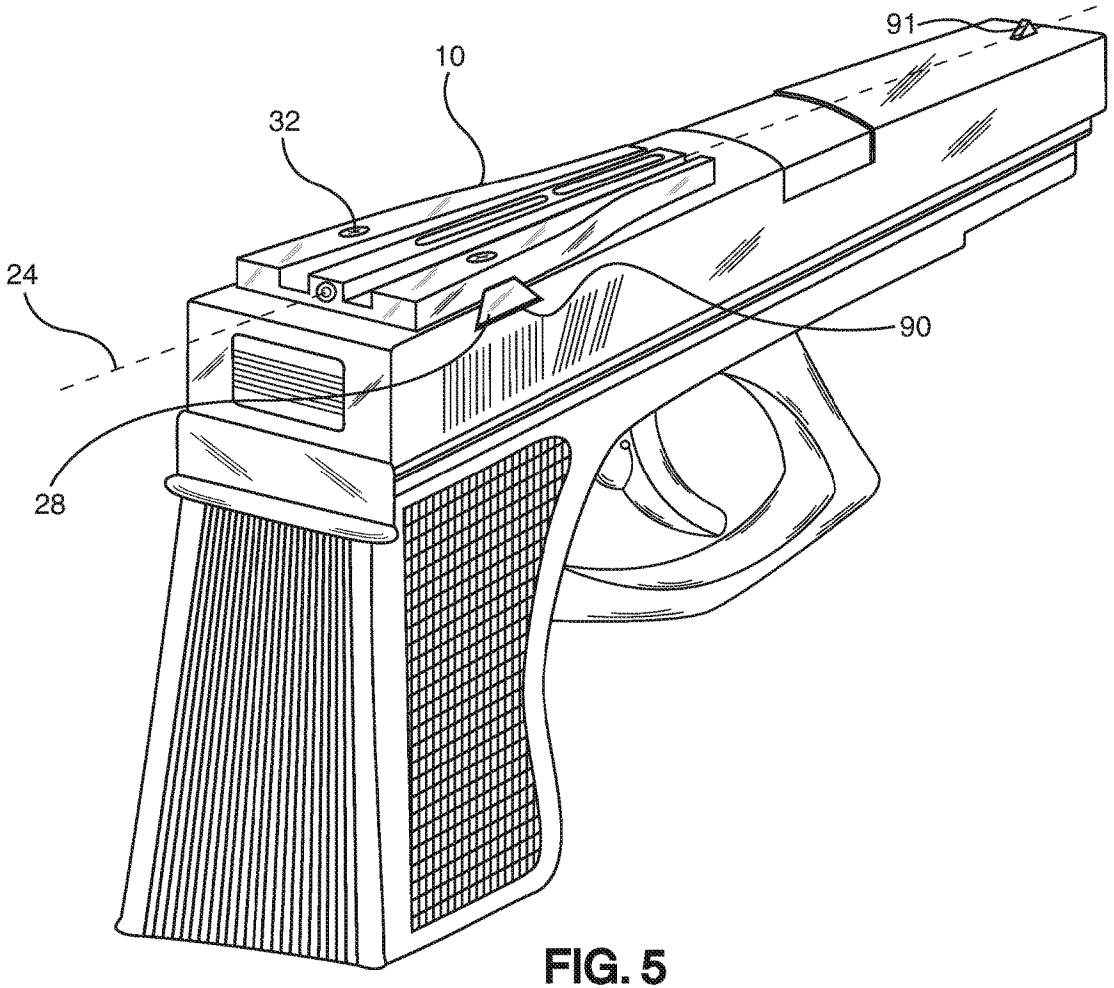
Figure 6:
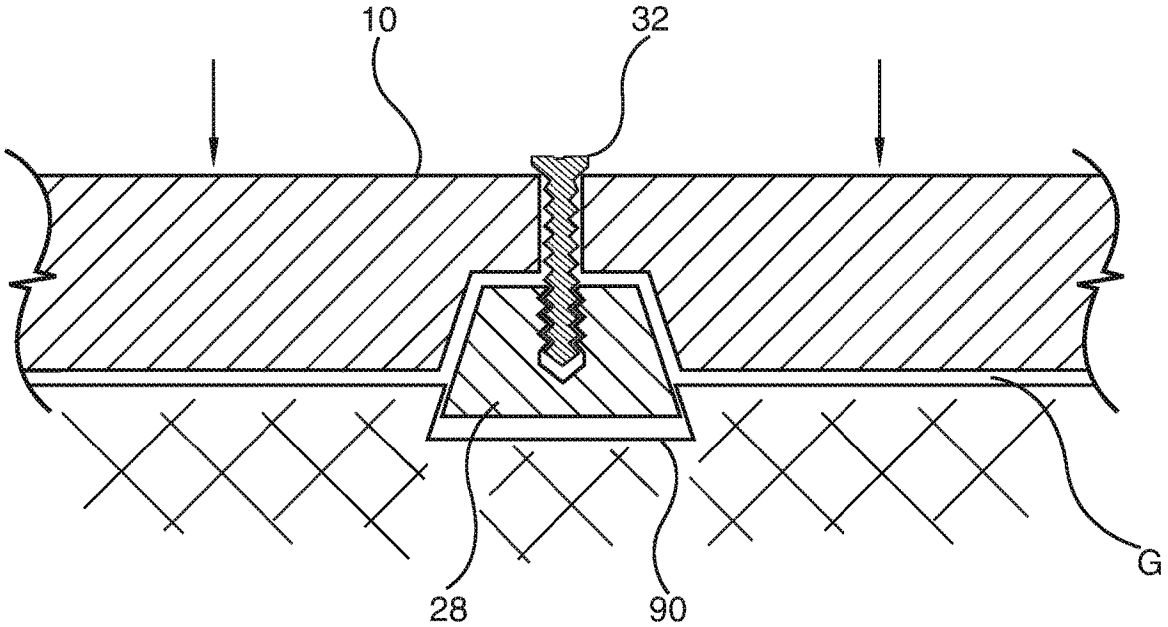
FIG. 6 is a sectional view illustrating an embodiment of an attachment mechanism for the present aiming device.

FIGS. 4-6 illustrate how the aiming device is mounted and the firearm is aimed. Tunnel 22 is parallel to the gun barrel. The aiming device is attached to the gun via attachment mechanism 18, which is typically accomplished as follows. Screws 32 are inserted into through-holes 34 and partially screwed into female screw receiving recesses 36 of attachment member 28. Attachment member 28, now with the remainder of the aiming device attached thereto, is slid into the aiming device attachment member receiving slot 90 of the tapering type, which is a common feature of such guns. Tunnel 22 is aligned with the front aiming sight 91 of the gun and then screws 32 are tightened to hold the aiming device securely and ensure also that bottom surface 20 rests flat on the top of the gun's barrel so that the tunnel is parallel to the gun's barrel. The just-mentioned attachment method is contrast to the typical pressure fit used and easily allows both assembly and adjustment.

Side walls 31 of attachment member 28 are configured, flat and smooth as noted above, so that the side walls readily slide upwardly in receiving slot 90 when attachment mechanism 18 is tightened (i.e. when the aiming device is assembled onto the firearm) whereby housing 10 firmly abuts the top face of the gun barrel. When screws 32 are tightened, attachment member 28 is pulled upward whereby side walls 31 abut tapered groove 30 in the firearm and also housing 10 is thus pulled downward toward the gun's barrel, to close the gap G (FIG. 6).

In some embodiments, the housing has a pair of channels 38 in the top side of the housing, parallel to optical fiber 12, one groove on each side of the optical fiber. These channels 38 make it easier for the shooter to see if the front sight is properly aligned, or more appropriately stated, if not properly aligned. This alignment aid provided by channels 38 is particularly helpful if housing 10 is opaque. This alignment feature provided by channels 38 can be most readily understood with reference to FIG. 4 where one can understand that at least the sides of front aiming sight 91 would be visible via channels 38 if the gun was improperly aimed to the right or left.

The aiming system allows the use of only two reference points to align the firearm both side-to-side and up and down with a target, those reference points being the front aiming sight 91 and either a luminous dot produced by light source 16 or an illuminated annular surface/circle produced by optical fiber 12, as transmitted through annular light-transmitting cylinder 14. In use, during aiming, the gun is typically tilted upward just a bit so that the front sight is visible to the shooter, and aligned with the aforementioned luminous dot, or illuminated circle. By using only two reference points (the front aiming sight 91 and either the luminous dot or luminous circle) aiming is more easily performed, even when the shooter keeps both eyes open and is aiming at a relatively distant target. The just mentioned aligning of luminous dot, or illuminated circle, with the front aiming sight 91 also properly affects side to side alignment, as noted above.

Figure 7:
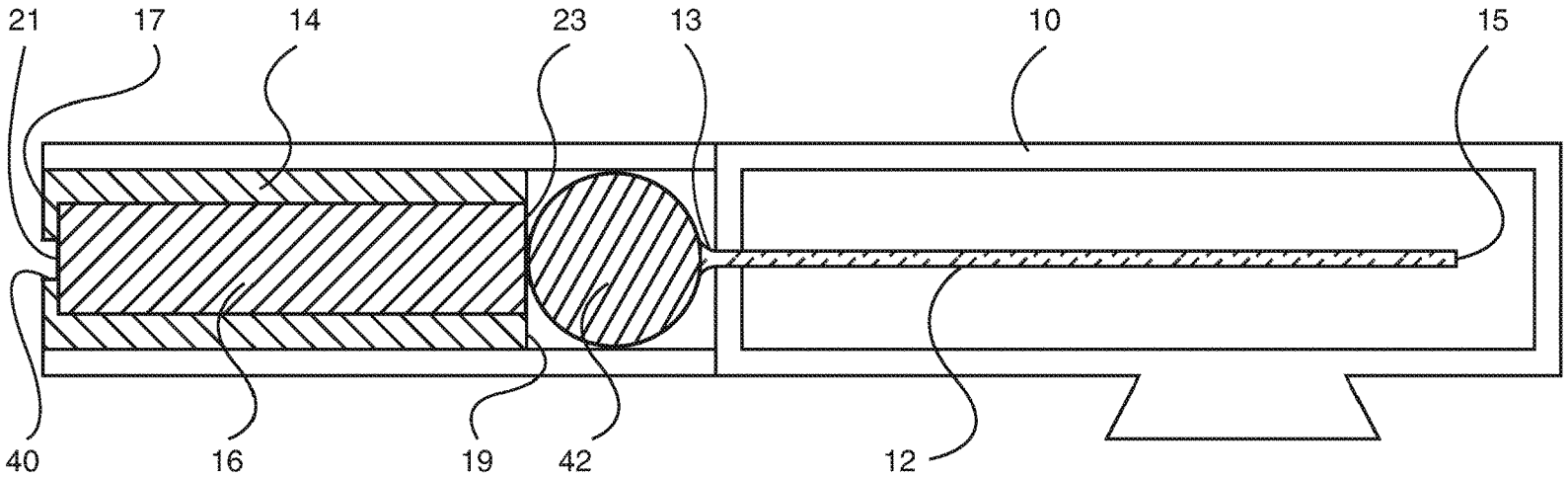
FIGS. 7-9 are side sectional views illustrating further embodiments of the present aiming device.

FIG. 7 shows another embodiment wherein annular light-transmitting cylinder 14 includes an inwardly facing shoulder 40 adjacent to front annular surface 17 thereof. Shoulder 40 may be annular and may be formed by any known means, including for example molding or drilling a first tunnel of a diameter equal to the inner diameter of the shoulder and then drilling a second wider tunnel to a point shortly before front annular surface 17. Shoulder 40 can be useful to help place and hold self-activating light source 16 within light-transmitting cylinder 14.

FIG. 7 shows another embodiment wherein optical fiber 12 is particularly thin, with a diameter smaller than the inner diameter of light-transmitting cylinder 14, and in some embodiments also thinner than self-activating light source 16. Such small diameter of optical fiber 12 can result in a lower cost optical fiber. In some embodiments, front end 13 of optical fiber 12 is mushroomed shaped or flared, as illustrated, which can help disperse/transmit light from the optical fiber. Optical fiber 12 can be held in tunnel 22 of housing 10 by any suitable mechanism.

FIG. 7 further shows an embodiment wherein the aiming device includes a lens 42 disposed intermediate optical fiber 12 and self-activating light source 16, as well as light-transmitting cylinder 14. Lens 42 has a diameter equal to the outer diameter of cylinder 14. As seen, lens 42 can be a simple spherical lens which is inexpensive. Lens 42 increases the diameter of the light transmitted by optical fiber 12 in order to ensure the light is transmitted to light-transmitting cylinder 14.

Figure 8:
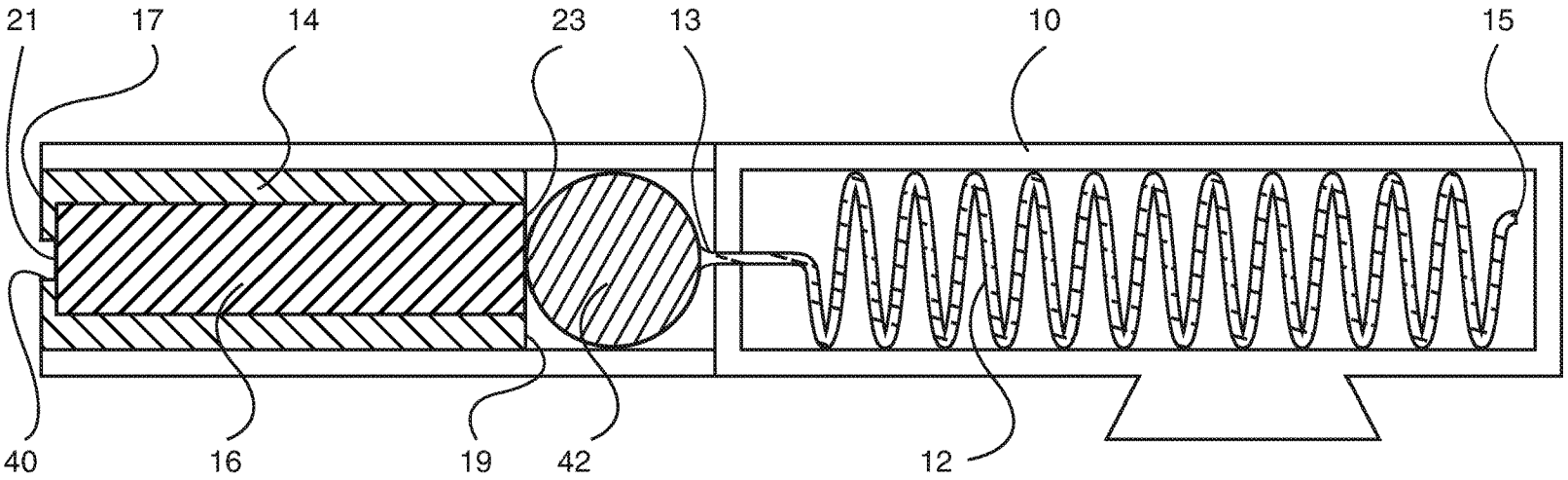
Figure 9:
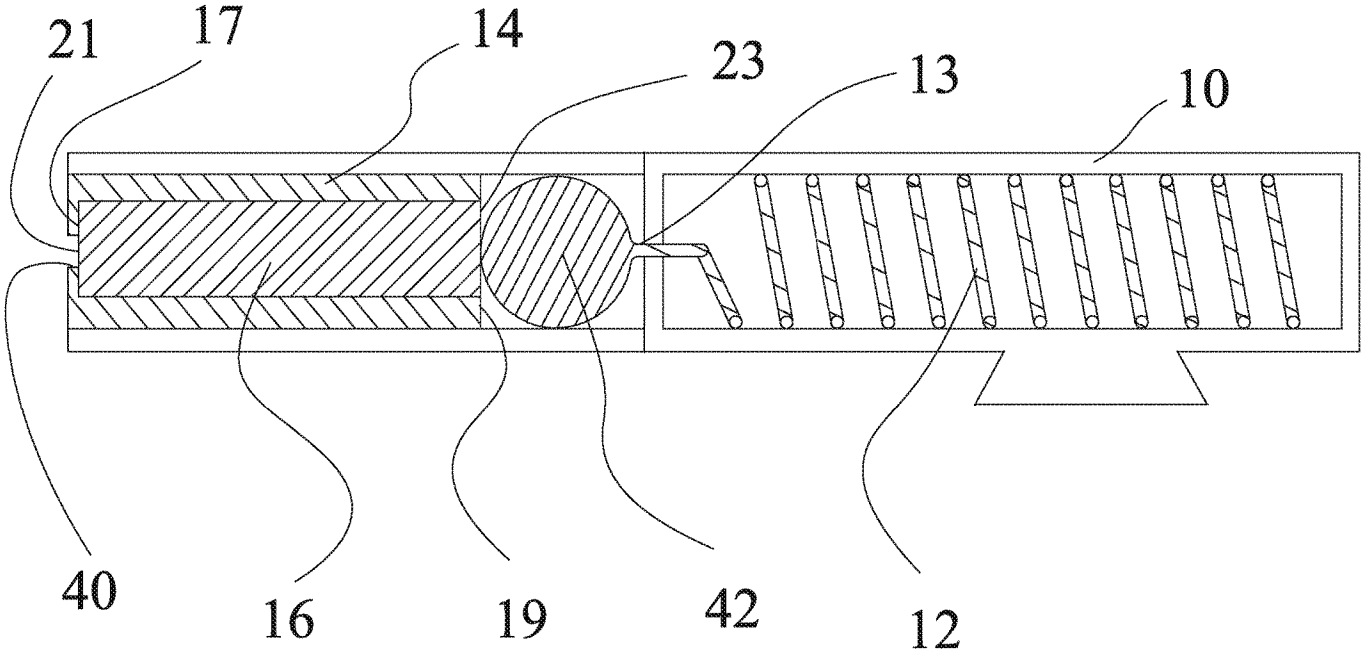

FIG. 8 shows embodiments wherein optical fiber 12, in a relatively thin (small diameter) form, as illustrated in FIG. 7, and is arranged in an exemplary non-linear (high surface area) configuration. FIG. 8 illustrates a serpentine configuration, and FIG. 9 illustrates a spiral or screw-thread like or coil-spring configuration. Other non-linear configurations may be used to produce more surface area to receive light. Non-linear configurations provide more surface area for light exposure and thus light transmission to the shooter than where optical fiber 12 is linear/straight, as in FIG. 7. The specific orientation of such non-linear optical fibers 12 can be in a variety of configurations, for example more tightly packed or in other geometries or forms, and not limited to the examples shown. In a specific example, the spiral configuration can be wound with its axis parallel to the tunnel (e.g. like a coil spring); with its axes perpendicular to the tunnel (e.g. like adjacent stacks of springs); or any other achievable winding/spiraling.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

What is claimed is:

1. A rear-sight aiming device to aid a shooter of a firearm, the firearm having a barrel, and a front aiming sight, the rear-sight aiming device comprising:

an elongated housing having a tunnel therein, the tunnel being configured so it is parallely arrangeable with the firearm's barrel and alignable with the front aiming sight and having at least one light admitting opening to the tunnel;

an elongated optical fiber having a front end and a rear end, the optical fiber being disposed inboard within the tunnel whereby at least a portion of the optical fiber is operably associated with the at least one light admitting opening, and the elongated fiber is in a non-linear configuration;

an annular light-transmitting cylinder, with a front annular surface and a rear annular surface, being open at both ends thereof and having an outer diameter and an inner diameter, the translucent annular light-transmitting cylinder being disposed within the tunnel between the optical fiber and the shooter of the firearm during shooting;

a self-activating light source having a front end and a rear end, the self-activating light source being disposed coaxially within the annular light-transmitting cylinder, whereby the self-activating light source is proximal the shooter of the firearm during shooting of the firearm;

a lens disposed adjacent to the elongated optical fiber and disposed intermediate the elongated optical fiber and the self-activating light source; and an attachment mechanism configured to attach the aiming device to the firearm, whereby the firearm can be aimed in a light or dark environment by aligning, with the front aiming sight of the firearm, the self-activating light source or the annular light-transmitting cylinder, which provides the shooter of the firearm with an illuminated dot by the self-activating light source or by an illuminated annular surface produced by the optical fiber, as transmitted through the light-transmitting cylinder.

2. The aiming device of claim 1, wherein the optical fiber has a diameter smaller than the inner diameter of the annular light-transmitting cylinder.

3. The aiming device of claim 1, wherein the non-linear configuration is a serpentine configuration.

4. The aiming device of claim 1, wherein the non-linear configuration is a spiral configuration.

5. The aiming device of claim 1, wherein the optical fiber has a flared front end.

6. The aiming device of claim 1, wherein the light transmitting cylinder has a shoulder adjacent the front annular surface thereof configured to help retain the self-activating light source within the light-transmitting cylinder.

7. The aiming device of claim 6, wherein the shoulder is annular.

8. The aiming device of claim 1, wherein the lens is a spherical lens.

9. The aiming device of claim 8, wherein the lens has a diameter equal to the outer diameter of the light-transmitting cylinder.

10. The aiming device of claim 1, wherein the optical fiber has a diameter smaller than that of the self-activating light source.

11. The aiming device of claim 1, wherein the self-activating light source is completely housed within the annular light transmitting cylinder.

* * * * *